US006506968B1

(12) United States Patent
Kurihara

(10) Patent No.: US 6,506,968 B1
(45) Date of Patent: Jan. 14, 2003

(54) SOUND SOURCE DEVICE

(75) Inventor: Shigeki Kurihara, Hyogo (JP)

(73) Assignee: Rohn Co., Ltd., Kyoto (JP)

( * ) Notice: Subject to any disclaimer, the term of this patent is extended or adjusted under 35 U.S.C. 154(b) by 0 days.

(21) Appl. No.: 09/701,151

(22) PCT Filed: Dec. 6, 1999

(86) PCT No.: PCT/JP99/06830

§ 371 (c)(1),
(2), (4) Date: Mar. 12, 2001

(87) PCT Pub. No.: WO00/58941

PCT Pub. Date: Oct. 5, 2000

(30) Foreign Application Priority Data

Mar. 26, 1999 (JP) ..... 11-083666

(51) Int. Cl.[7] ..... G10H 7/00; G11C 11/00
(52) U.S. Cl. ..... 84/604; 84/606; 84/605
(58) Field of Search ..... 84/600–609, 622–625, 84/627, 649

(56) References Cited

U.S. PATENT DOCUMENTS 3,854,365 A * 12/1974 Tomisawa et al. ..... 84/605
4,815,352 A * 3/1989 Tsukamoto et al. ..... 84/617
4,974,485 A * 12/1990 Nagai et al. ..... 84/605
5,268,528 A * 12/1993 Iwase ..... 84/660

FOREIGN PATENT DOCUMENTS

| | | |
|---|---|---|
| GB | 2 218 252 | 11/1989 |
| JP | 2-83597 | 6/1990 |
| JP | 8-8652 | 1/1996 |
| JP | 8-211868 | 8/1996 |
| JP | 10-268863 | 10/1998 |

* cited by examiner

*Primary Examiner*—Marlon T. Fletcher
(74) *Attorney, Agent, or Firm*—McDermott, Will & Emery

(57) ABSTRACT

The present invention relates to a sound source device, and more particularly, it aims at providing a sound source device, in which a sufficient sound emitting quantity can be attained, capable of obtaining a reproduced sound of musically rich expression.

And, in order to attain the aforementioned object, it is possible to solve such a problem that energy density is low and sound emitting efficiency is inferior by employing a pseudo-rectangular wave increasing spectral density as waveform data input in a waveform table (TB). For this, it is rendered a spectrum including spectral lines X1, X2, X3 and X4 in a range matching with a frequency domain (HR) having high sound emitting efficiency and including even harmonics.

17 Claims, 12 Drawing Sheets

SOUND SOURCE DEVICE

TECHNICAL FIELD

The present invention relates to an improvement of a sound source device for a portable apparatus having a sound emitting part whose frequency domain is limited.

BACKGROUND TECHNICAL

In general, a sound source device included in an electronic instrument or the like converts artificial sounds generated on the basis of rectangular waves, sawtooth waves and sinusoidal waves or those recording and editing natural sounds, instrumental sounds or the like to a digital quantity with an A-D converter or the like and performs waveform generation with previously set waveform data, while a speaker or the like having an excellent sounding band is connected to a reproduction system in this case.

On the other hand, a sound emitting part of a speaker or the like provided on a portable apparatus such as a portable telephone is designed miniature, lightweight and thin in order to make the best use of portability characterizing the portable apparatus. Therefore, an efficient frequency domain in its frequency characteristics becomes a limited one and is not suitable for reproduction of music requiring a wide frequency domain, while it operates at a low voltage of about 3 V as to its internal operating pressure and hence sound pressure is also low.

In the portable apparatus such as a portable telephone, as hereinabove described, only a sound emitting part whose efficient frequency domain is limited can be used due to restriction in structure, a sufficient sound emitting quantity cannot be obtained, and musical expression has also been limited.

The present invention has been proposed in order to solve the aforementioned problems, and aims at providing a sound source device, in which a sufficient sound emitting quantity can be attained also in a portable apparatus such as a potable telephone, capable of obtaining reproduced sounds of musically rich expression.

DISCLOSURE OF THE INVENTION

A first mode of the sound source device according to the present invention is a sound source device comprising a waveform table having previously generated waveform data and a waveform reading part reading the said waveform data from the said waveform table at an arbitrary reading interval for reading the said waveform data at a prescribed interval on the basis of externally supplied music performance information and outputting the same from a sound emitting part as a reproduced sound, in which the said waveform data is a pseudo-rectangular wave obtained by eliminating a harmonic component exceeding a prescribed order from a rectangular wave.

According to the first aspect of inventive the sound source device, the pseudo-rectangular wave obtained by eliminating the harmonic component exceeding the prescribed order from the rectangular wave is such that the top portion of the wave has a corrugated shape where a plurality of irregularities having different heights continue, whereby, also when part of the top portion reaches the maximum range of an amplifier in formation of a chord, for example, the overall top portion is prevented from being cut and the reproduced sound is prevented from occurrence of a feeling of unfitness. As to the aforementioned pseudo-rectangular wave, further, it follows that leading and trailing edges a pulse have inclinations, whereby generation of folding noise resulting from abrupt swinging of the waveform in the time-base direction, the so-called jitter, can be suppressed and audibility can be improved. In addition, it eliminates the harmonic component exceeding the prescribed order, i.e., eliminates a high-order harmonic component, whereby the harmonic component is prevented from exerting influence on a peripheral device and the overall system can be stably operated.

A second aspect of the sound source device according to the present invention is such that the said eliminated harmonic component is a harmonic component having a frequency exceeding a prescribed frequency domain in at least the frequency characteristics of the said sound emitting part.

According to the second aspect of the inventive sound source device, it eliminates a harmonic component of a frequency at least exceeding the prescribed frequency domain in the frequency characteristics of the sound emitting part, whereby a high-order harmonic component can be eliminated and a reproduced sound matching with sound emitting characteristics of the sound emitting part can be obtained when setting a domain of the sound emitting part having excellent sound emitting efficiency as the prescribed frequency domain, for example.

A third aspect of the sound source device according to the present invention is such that the said pseudo-rectangular wave has such spectral density that spectral density in a prescribed frequency domain in the frequency characteristics of the said sound emitting part in the case of Fourier-transforming the pseudo-rectangular wave is higher than a rectangular wave having a pulse duty factor of 50%.

According to the third aspect of the inventive sound source device, the spectral density of the pseudo-rectangular wave becomes higher than the rectangular wave having the pulse duty factor of 50%, whereby a reproduced sound obtained with this pseudo-rectangular wave improves in energy density, improve becomes an excellent reproduced sound.

A fourth aspect of the sound source device according to the present invention is such that the said pseudo-rectangular wave is such that the spectral quantity of spectral lines excluding at least a reference spectral line among spectral lines in the said prescribed frequency domain in the case of Fourier-transforming the said pseudo-rectangular wave is at a value obtained by multiplying the spectral quantity at a corresponding frequency by a prescribed coefficient in a continuous spectrum in the case of Fourier-transforming an isolated rectangular wave.

According to the fourth aspect of the inventive sound source device, the spectral quantity of the pseudo-rectangular wave becomes large, whereby a reproduced sound obtained with this pseudo-rectangular wave not only improves in energy density and improves in sound emitting efficiency but also a sound emitting quantity rises and a more excellent reproduced sound can be obtained.

A fifth aspect of the sound source device according to the present invention is a sound source device comprising a waveform table having previously generated waveform data and a waveform reading part reading the said waveform data from the said waveform table at an arbitrary reading interval for reading the said waveform data at a prescribed interval on the basis of externally supplied music performance information and outputting the same from a sound emitting part as a reproduced sound, in which the said waveform data is such a pseudo-rectangular wave that the top potion of the wave has a corrugated shape where irregularities continue and leading and trailing edges of the waveform have inclinations.

According to the fifth aspect of the inventive sound source device, the top portion of the wave has a corrugated shape where a plurality of irregularities continue, whereby, also when part of the top portion reaches the maximum range of an amplifier in formation of a chord, for example, the overall top portion is prevented from being cut and the reproduced sound is prevented from occurrence of a feeling of unfitness. Further, the leading and trailing edges of a pulse have inclinations, whereby generation of folding noise resulting from abrupt swinging of the waveform in the time-base direction, the so-called jitter, can be suppressed and audibility can be improved.

A sixth aspect of the sound source device according to the present invention is such that the said pseudo-rectangular wave is such that the pulse widths of two pulse waves included in one cycle are different from each other.

According to the sixth aspect of the inventive sound source device, the spectral density of such a pseudo-rectangular wave that the pulse widths of two pulse waves included in one cycle are different from each other becomes higher than a rectangular wave having a pulse duty factor of 50%, whereby a reproduced sound obtained with this pseudo-rectangular wave improves in energy density, improves in sound emitting efficiency and becomes an excellent reproduced sound.

A seventh aspect of the sound source device according to the present invention is such that the said pseudo-rectangular wave is such that heights of the said irregularities include different heights.

According to the seventh aspect of the inventive sound source device, the heights of the plurality of irregularities of the pseudo-rectangular wave are different from each other, whereby, even if a most projecting part of the top portion reaches the maximum range of an amplifier and is cut in formation of a chord, for example, the remaining parts are not cut, whereby the reproduced sound is prevented from occurrence of a feeling of unfitness.

An eighth aspect of the sound source device according to the present invention is such that the said waveform tables are plural and have waveform data of the same form respectively.

According to the eighth aspect of the inventive sound source device, the plurality of waveform tables have waveform data of the same form respectively, whereby it is possible to readily form a chord by reading the same while varying reading intervals in a waveform reading part and adding these, for example.

A ninth aspect of the sound source device according to the present invention is such that the said waveform tables are plural and have waveform data of different forms respectively.

According to the ninth aspect of the inventive sound source device, excellent reproduced sounds can be obtained with respect to various music performance information by so devising that each is having a pseudo-rectangular wave having high spectral density or a high spectral quantity in the prescribed frequency domain in the frequency characteristics of the sound emitting part also when the frequencies are different, for example, in the respective ones of the plurality of waveform tables thereby selecting a pseudo-rectangular wave of a proper frequency in correspondence to information from a music performance information source. Further, it also becomes possible to reproduce various instrumental sounds having different tone colors by inputting pseudo-rectangular waves of different timbre in the respective ones of the plurality of waveform tables.

A tenth aspect of the sound source device according to the present invention further comprises control means controlling an operation of reading the waveform data of the said plural waveform tables at various frequencies respectively and superposing the same and an operation of differently using the same individually in compliance with the said music performance information.

According to the tenth aspect of the inventive sound source device, excellent reproduced sounds can be obtained with respect to formation of a chord and various types of music performance information.

The objects, features, aspects and advantages of the present invention will become more apparent from the following detailed description and the accompanying drawings.

BEST MODE FOR CARRYING OUT THE INVENTION

A. Device Structure

Figure 1:
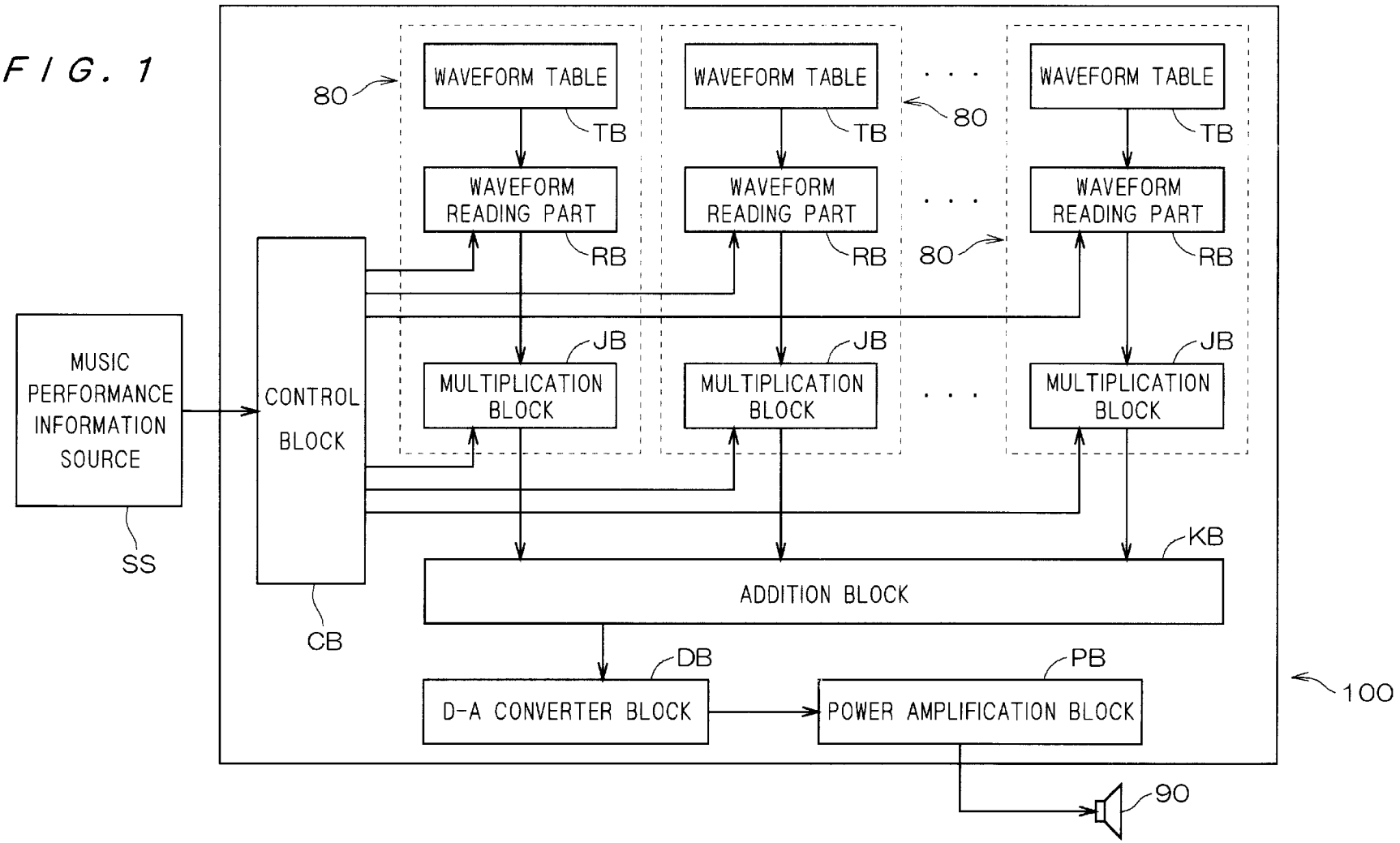
FIG. 1 is a block diagram illustrating the structure of a sound source device according to the present invention.
Figure 2:
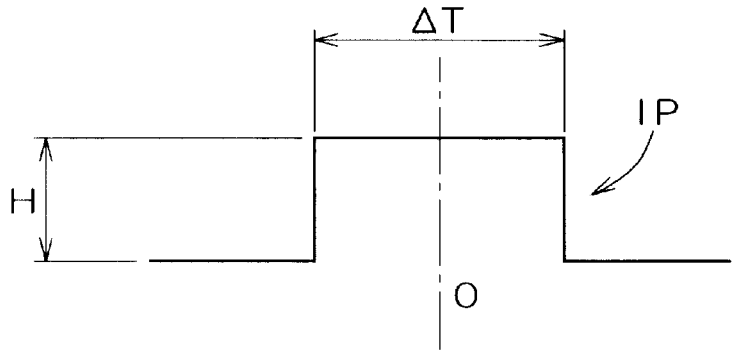
FIG. 2 is a diagram illustrating an isolated rectangular wave.

FIG. 1 is a block diagram showing the structure of a sound source device 100 of an embodiment according to the present invention.

As shown in FIG. 1, the sound source device 100 comprises a plurality of waveform forming parts 80 each structured by a waveform table TB structured by storage means such as a random access memory or a read only memory (ROM), for example, storing previously formed waveform data in compliance with an efficient frequency domain of a sound emitting part 90, a waveform reading block RB reading the waveform data of this waveform table TB at arbitrary time intervals, and a multiplication block JB storing a coefficient for hourly changing the value of the read waveform data and forming an attenuating waveform and a coefficient for sound volume adjustment for obtaining a reproduced sound more pleasant to the ears and multiplying the waveform data by these coefficients.

Further, it comprises an addition block KB adding digital data formed in the waveform forming parts 80, a D–A conversion block DB converting the added digital data added in the addition block KB to an analog quantity, and a power amplification block PB amplifying the aforementioned analog quantity and outputting the same to the sound emitting part 90.

The waveform reading block RB and the multiplication block JB of the waveform forming part 80 are in structures controlled by the control block CB on the basis of information from a music performance information source SS provided outside the sound source device 100 for performing reading and manipulation of the waveform data.

In the sound source device 100 of such a structure, what becomes the characteristic part of the present invention is the point that it stores the waveform data previously formed in compliance with the efficient frequency domain in the frequency characteristics of the sound emitting part 90 in the waveform table TB. The waveform data stored in the waveform table TB are now described.

B. As to Waveform Data:

B1. Problem in the Case of Employing Rectangular Wave as Waveform Data:

First, an example of waveform data formation is described with reference to FIG. 2 to FIG. 5.

While a practical frequency domain is generally 40 Hz to 4 kHz in a sounding part of a portable apparatus such as a portable telephone, the sound pressure lowers when sounding music of about 400 Hz with a sine wave, for example, and it is not practical. Therefore, a rectangular wave capable of widening a waveform area and capable of obtaining large reproducing power is used for sounding a call melody or the like for a portable telephone or the like.

However, a general rectangular wave has the following problem: First, assume a single isolated rectangular wave (isolated pulse) IP shown in FIG. 2. The isolated rectangular wave IP shown in FIG. 2 has a pulse width ΔT and a pulse height H with reference to a time 0.

Then Fourier-transform the isolated rectangular wave IP existing as an even function with reference to the time 0. When performing integration in a limited time range ΔT with respect to a function taking a constant value in a time-base region from minus infinity to plus infinity, the result becomes a con tinuous spectral function according to the definition of Fourier transform. Therefore, the isolated rectangular wave IP becomes a continuous spectral function expressed in the following numerical formula (1):

$$f(x)=A\cdot(\sin Bx/Bx) \quad (1)$$

Here, the coefficient A is a coefficient expressing the magnitude of a spectrum and the coefficient B is a coefficient inversely proportionate to the pulse width ΔT of the isolated rectangular wave IP, while sin represents a sine function and x represents a frequency.

Figure 3:
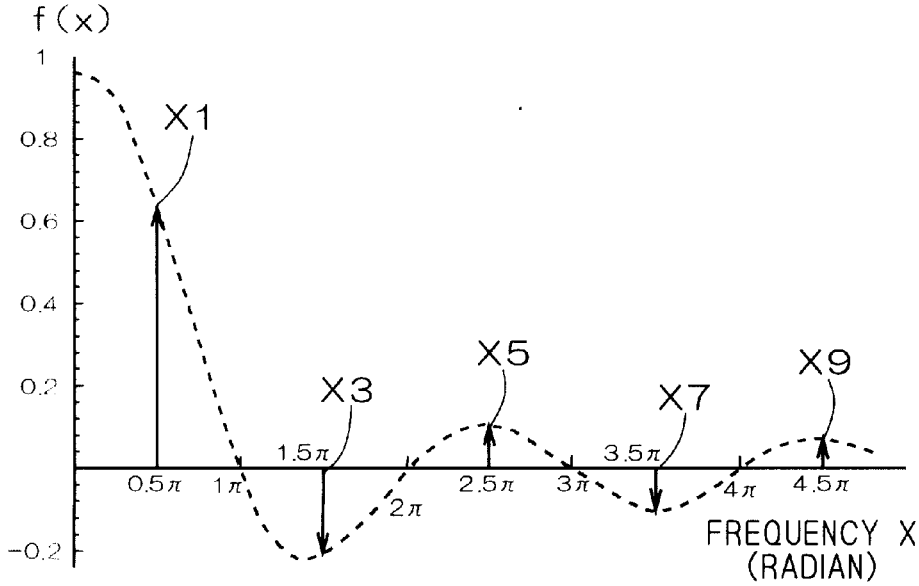
FIG. 3 is a diagram illustrating Fourier transform of the isolated rectangular wave.

FIG. 3 graphs out the numerical formula (1). FIG. 3 shows the frequency x on the horizontal axis in radian notation, and shows the value of the spectral function f(x) on the vertical axis. Referring to FIG. 3, the envelope showing the isolated rectangular wave takes values of zero at frequencies 1π, 2π, 3π and 4π.

A generally used continuous rectangular wave having a pulse duty factor of 50% is that sampling only odd harmonics in the function f(x) of the numerical formula (1). FIG. 3 denotes spectral lines X1, X3, X5, X7 and X9 of the odd harmonics with arrows.

Figure 4:
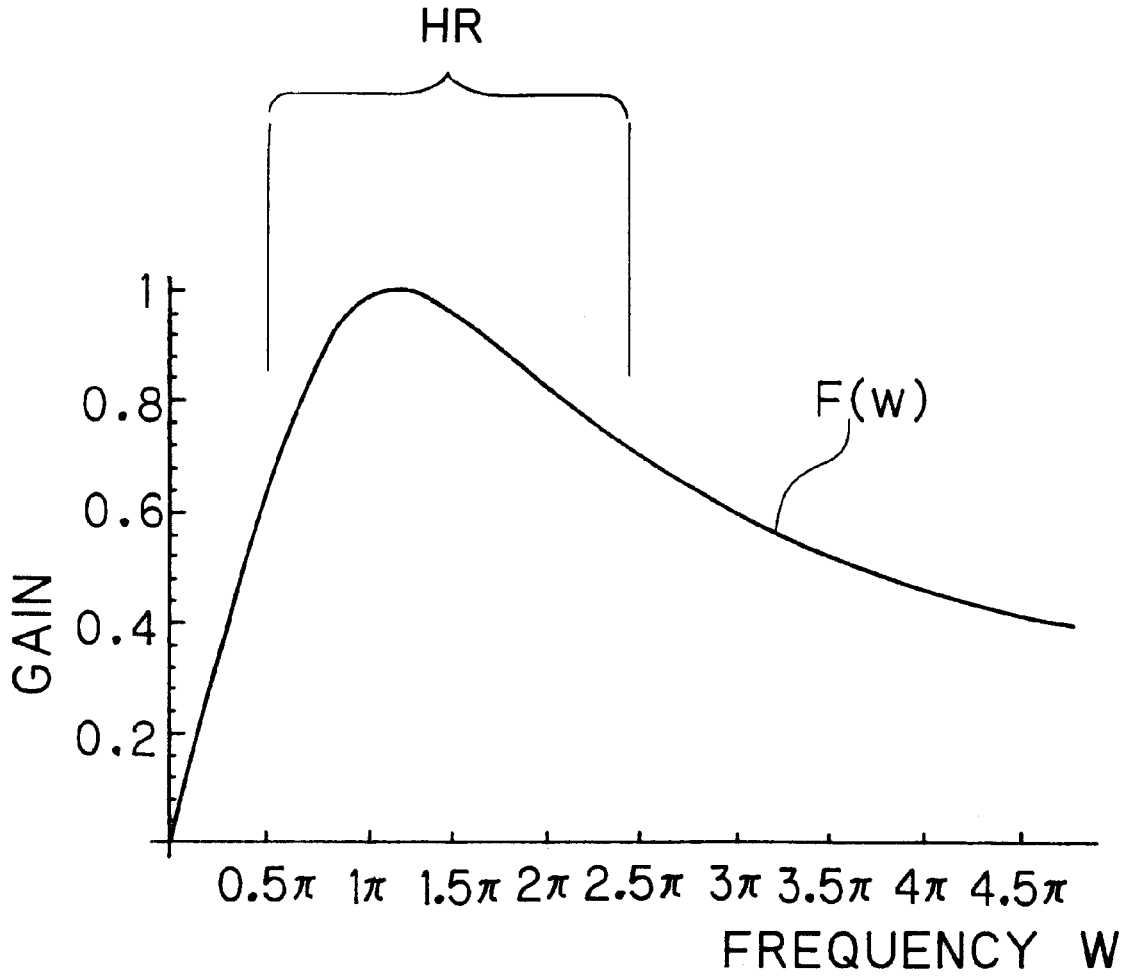
FIG. 4 is a diagram showing the frequency characteristics of a sound emitting part.

Then, FIG. 4 shows frequency characteristics F(w) of the sound emitting part 90 connected to the sound source device 100. FIG. 4 shows the frequency w on the horizontal axis in radian notation, and shows the gain on the vertical axis. In the frequency characteristics F(w) of the sound emitting part 90, a frequency domain HR (hereinafter simply referred to as "frequency domain HR") having high sound emitting efficiency is within the range of 0.5 π radians to 2.5 π radians, and this domain becomes a main reproduced frequency domain in the sound emitting part 90. While the frequency domain HR in FIG. 4 substantially corresponds to a frequency domain where the gain becomes at least 0.6, it is also possible to regard sound emitting efficiency as high if the gain is at least 0.5 depending on the shape of a characteristic curve, and hence it is also possible to set a frequency domain where the gain becomes at least 0.5 as the frequency domain HR.

Figure 5:
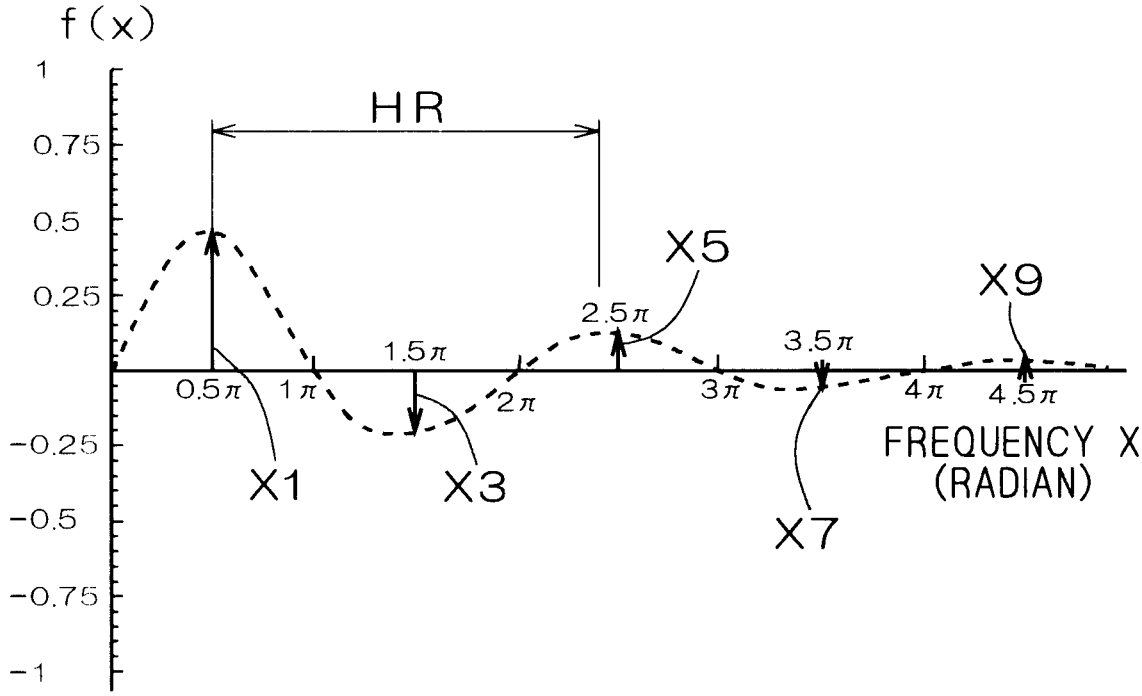
FIG. 5 is a diagram showing the spectrum of a rectangular wave having a pulse duty ratio of 50% reproduced in the sound emitting part.

In the sound emitting part 90 having such a frequency domain HR, it becomes a spectrum shown in FIG. 5 when reproducing the waveform having the spectrum shown in FIG. 3.

Referring to FIG. 5, spectral lines in the frequency domain HR are only two of X1 and X3, energy density is low and sound emitting efficiency is inferior. In other words, it becomes a reproduced sound that cannot be heard well.

When inputting a rectangular wave in the plurality of waveform tables TB of the sound source device 100 shown in FIG. 1 as waveform data, reading the same while varying the reading speeds respectively in the respective waveform reading blocks RB and adding the same thereby performing superposition of waveforms whose frequencies are different (i.e., formation of a chord), the top portion of the rectangular wave is generally flat and hence becomes a reproduced sound having a feeling of unfitness similarly to the case where the top portion is cut in the maximum range of an amplifier.

B-2. Pseudo-Rectangular Wave:

In order to solve the latter problem, there is a method rendering the waveform data input in the waveform tables TB not a rectangular wave but a pseudo-rectangular wave. An example of the pseudo-rectangular wave is now described.

Figure 6:
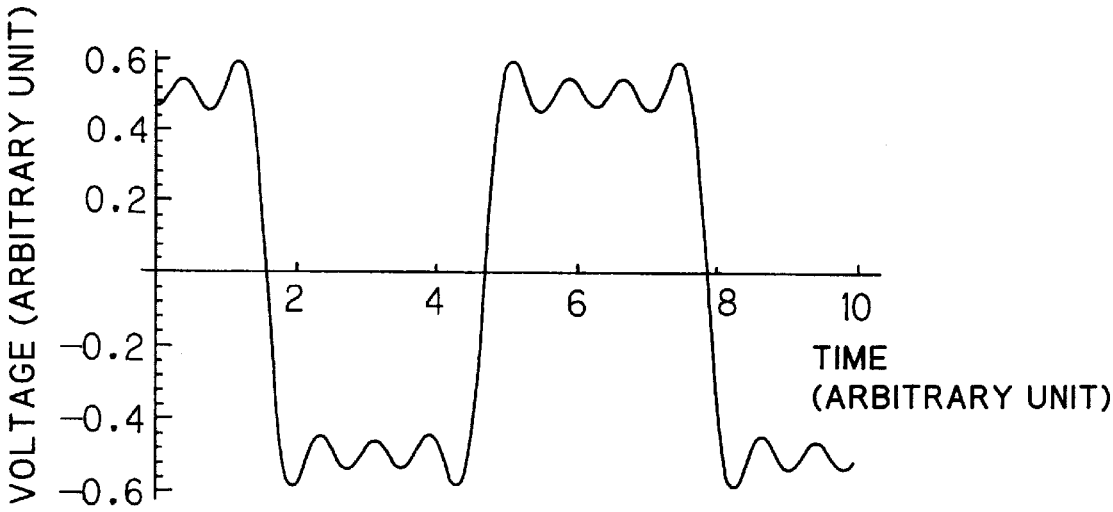
FIG. 6 is a diagram showing a pseudo-rectangular wave having a pulse duty ratio of 50%.

The simplest structure of the pseudo-rectangular wave is obtained by eliminating a high-order harmonic component from a rectangular wave. FIG. 6 shows a pseudo-rectangular wave having a pulse duty factor of 50%. FIG. 6 shows time (arbitrary unit) on the horizontal axis and shows voltage (arbitrary unit) on the vertical axis.

As shown in FIG. 6, the top portion of the pseudo-rectangular wave eliminating a high-order harmonic component is not flat dissimilarly to a general rectangular wave, but becomes a corrugated shape where a plurality of irregularities of different heights continue. Further, leading and trailing edges of a pulse are not perpendicular but have slight inclinations.

The pseudo-rectangular wave of FIG. 6 is derived by sine-synthesizing points of the odd harmonics on the envelope shown in FIG. 3 obtained by Fourier-transforming the isolated rectangular wave excluding a high-order odd harmonic (i.e., high-order harmonic) and performing inverse Fourier transform.

In other words, it is possible to obtain the pseudo-rectangular wave by sine-synthesizing values of a specific frequency train Xn, i.e., values obtained in the following numerical formula (2) in the continuous function shown in the numerical formula (1) and performing inverse Fourier transform:

$$f(Xn)=A\cdot(\sin BXn/BXn) \quad (2)$$

When selecting Xn=(X1, X3, X5, X7), for example, a pseudo-rectangular wave having a pulse duty ratio of 50% excluding odd harmonics exceeding the ninth order among odd harmonics can be obtained.

By inputting such a pseudo-rectangular wave in the waveform tables TB, the overall top portion is prevented from being cut and the reproduced sound is prevented from occurrence of a feeling of unfitness even if part of the top portion reaches the maximum range of the amplifier in formation of a chord.

The irregularities of the top potion have different heights, and hence a cut area may be small even if part of the irregularities reaches the maximum range of the amplifier.

The leading and trailing edges of the pulse have inclinations, whereby generation of folding noise resulting from abrupt swinging of the waveform in the time-base direction, the so-called jitter, can be suppressed. the waveform data from the waveform tables TB is performed at prescribed time intervals, the read waveform may be discontinuous in such a rectangular waveform that the leading and trailing edges a pulse are vertical depending on the reading intervals and an unnecessary spectrum is generated to become folding noise, while the pseudo-rectangular wave an suppress this and improve audibility.

The high-order harmonic component is eliminated, whereby the harmonic component is prevented from exerting influence on a peripheral device and the overall system can be stably operated.

B-3. Pseudo-Rectangular Wave Increasing Spectral Density:

In order to solve such a problem that energy density is low and sound emitting efficiency is inferior in the mere rectangular wave having a pulse duty factor of 50% there is a method employing a pseudo-rectangular wave increasing spectral density as the waveform data input in the waveform tables TB. T he pseudo-rectangular wave increasing spectral density is now described.

Referring to FIG. 5, the spectral lines in the frequency domain HR become only two of X1 and X3 since only X1 and X3 exist in the frequency domain HR among the spectral lines of the odd harmonics shown in FIG. 3. Standing on the viewpoint of increasing the spectral density, it can be said suitable to improvement of reproduction efficiency to properly change the coefficient B in the numerical formula (2) to render it a waveform including even harmonics within a range matching with the frequency domain HR.

Figure 7:
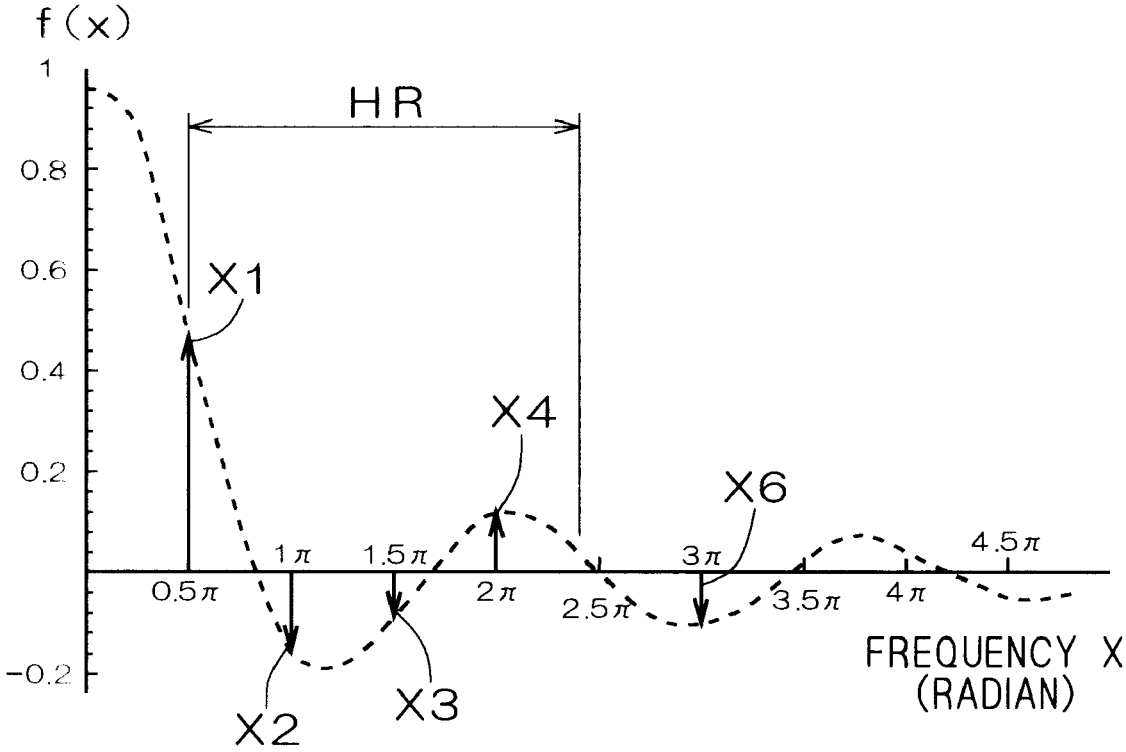
FIG. 7 is a diagram showing a spectrum for synthesizing a pseudo-rectangular wave including even harmonics.

So, FIG. 7 shows a spectrum for synthesizing a pseudo-rectangular wave including even harmonics. Referring to FIG. 7, spectral lines X1, X2, X3 and X4 exist within the range matching with the frequency domain HR, and it follows that the number of the spectral lines doubles as compared with the case of FIG. 3.

Figure 8:
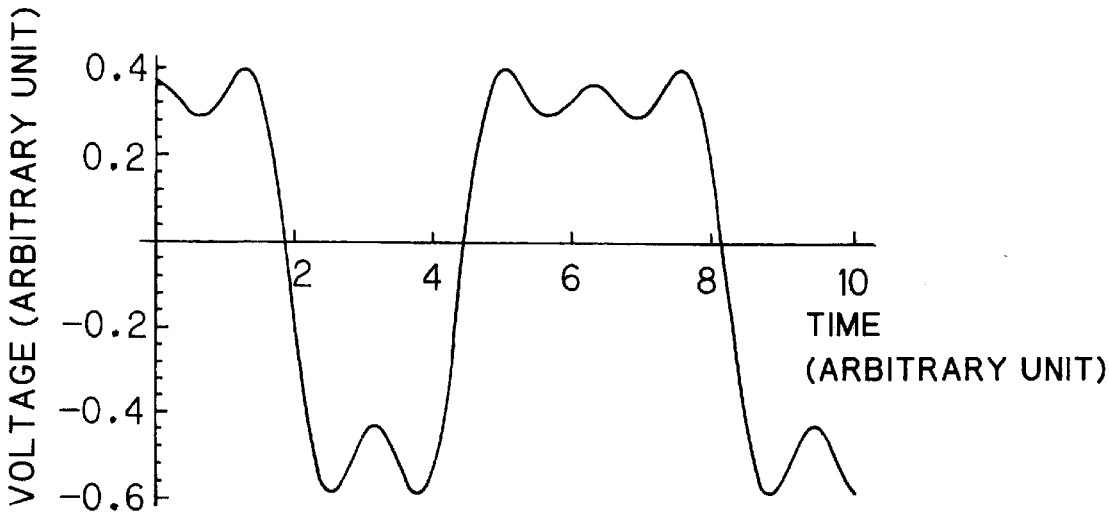
FIG. 8 is a diagram showing the pseudo-rectangular wave including the even harmonics.

Then, FIG. 8 shows the pseudo-rectangular wave increasing spectral density synthesized on the basis of the spectrum shown in FIG. 7. In FIG. 8, time (arbitrary unit) is shown on the horizontal axis and voltage (arbitrary unit) is shown on the vertical axis. Referring to FIG. 7, it includes only harmonic components up to the sixth order, and hence the pseudo-rectangular wave of FIG. 8 becomes such a one that harmonic components exceeding the seventh order are eliminated.

As shown in FIG. 8, the pulse duty factor of the pseudo-rectangular wave increasing spectral density is not 50% dissimilarly to the pseudo-rectangular wave shown in FIG. 6, and the number of irregularities reduces in the corrugated shape of the top portion. Inclinations of the leading and trailing edges of the pulse also become loose.

Figure 9:
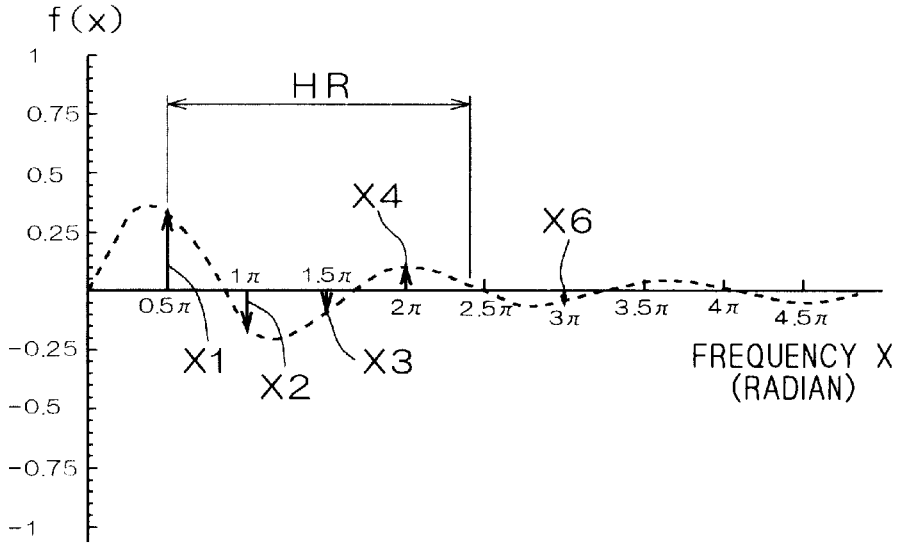
FIG. 9 is a diagram showing the pseudo-rectangular wave including the even harmonics reproduced in the sound emitting part.

Next, FIG. 9 shows a spectrum in the case of inputting the pseudo-rectangular wave increasing spectral density shown in FIG. 8 in the waveform tables TB and emitting a sound from the sound emitting part 90 through a reproducing system.

From FIG. 9, it is understood that spectral lines within the frequency domain HR become four of X1, X2, X3 and X4 and the spectral density becomes high. Therefore, sound emitting efficiency improves due to improvement of energy density and an excellent reproduced sound can be obtained.

B-4. Pseudo-Rectangular Wave Increasing Spectral Quantity:

While a sound emitting quantity cannot be increased by merely increasing spectral density, the sound emitting quantity can be increased by increasing the spectral quantities of the spectral lines within the frequency domain HR. A pseudo-rectangular wave increasing the spectral quantity is now described.

Figure 10:
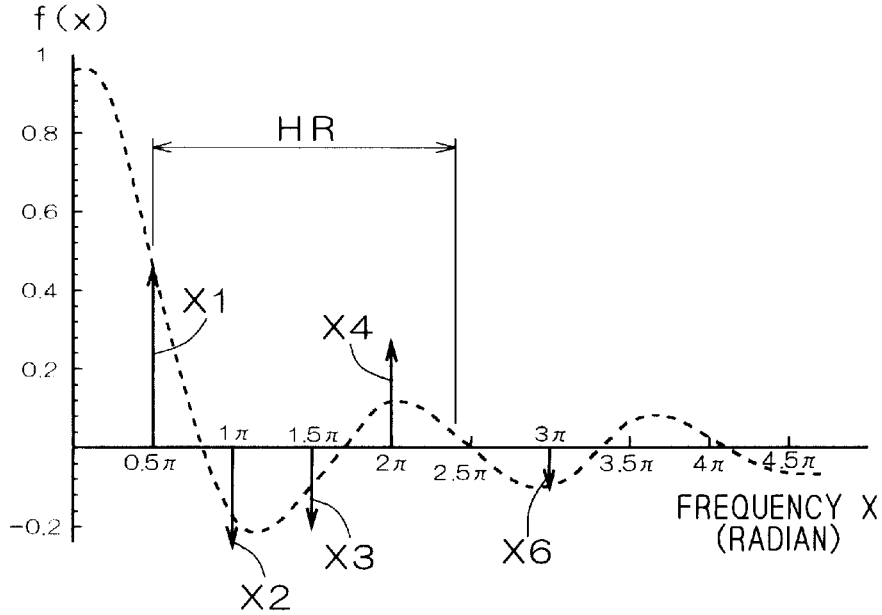
FIG. 10 is a diagram showing a spectrum for synthesizing a pseudo-rectangular wave whose spectral quantity is increased.

FIG. 10 shows a spectrum for synthesizing the pseudo-rectangular wave increasing the spectral quantities. Referring to FIG. 10, it is similar to FIG. 7 in the point that the spectral lines X1, X2, X3 and X4 exist in the range matching with the frequency domain HR, while the spectral quantities of the spectral lines X2, X3 and X4 other than the spectral line X1 which is a reference line increase. The degree of the increase is such that the spectral lines X2, X3 and X4 increase to 1.2 times, 1.3 times and twice as compared with the values on the envelope (i.e., the values at frequencies corresponding to the spectral lines X2, X3 and X4 in a continuous spectrum obtained by Fourier-transforming an isolated rectangular wave).

Figure 11:
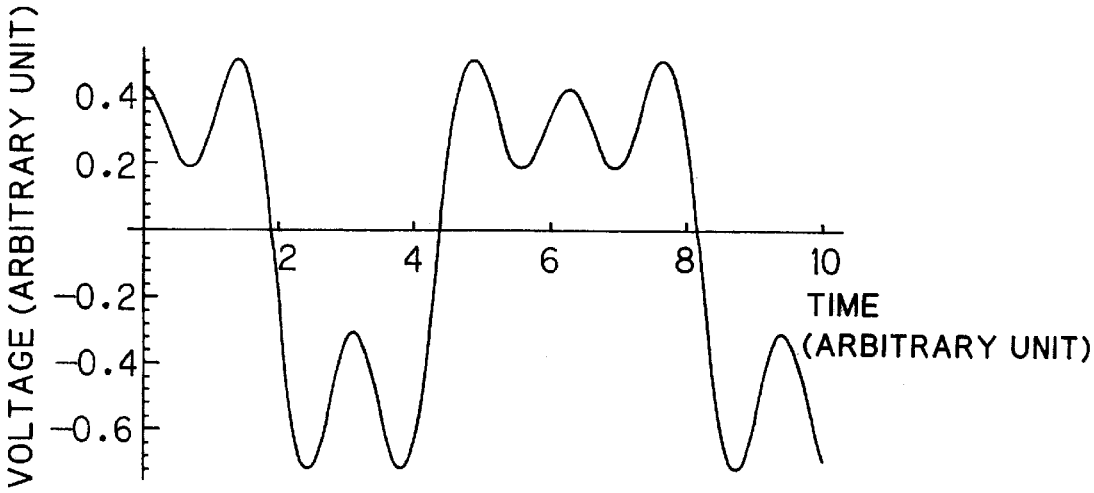
FIG. 11 is a diagram showing the pseudo-rectangular wave whose spectral quantity is increased.

FIG. 11 shows the pseudo-rectangular wave increasing the spectral quantities synthesized on the basis of the spectrum shown in FIG. 10. In FIG. 11 time (arbitrary unit) is shown on the horizontal axis and voltage (arbitrary unit) is shown on the vertical axis. It includes only harmonic components up to the sixth order in FIG. 10, and hence the pseudo-rectangular wave of FIG. 11 becomes such a one that harmonic components exceeding the seventh order are eliminated.

As shown in FIG. 11, the high-low difference of irregularities increases in the corrugated shape of the top portion and inclinations of leading and trailing edges of the pulse also become looser in the pseudo-rectangular wave increasing the spectral quantities as compared with the pseudo-rectangular wave shown in FIG. 8.

Figure 12:
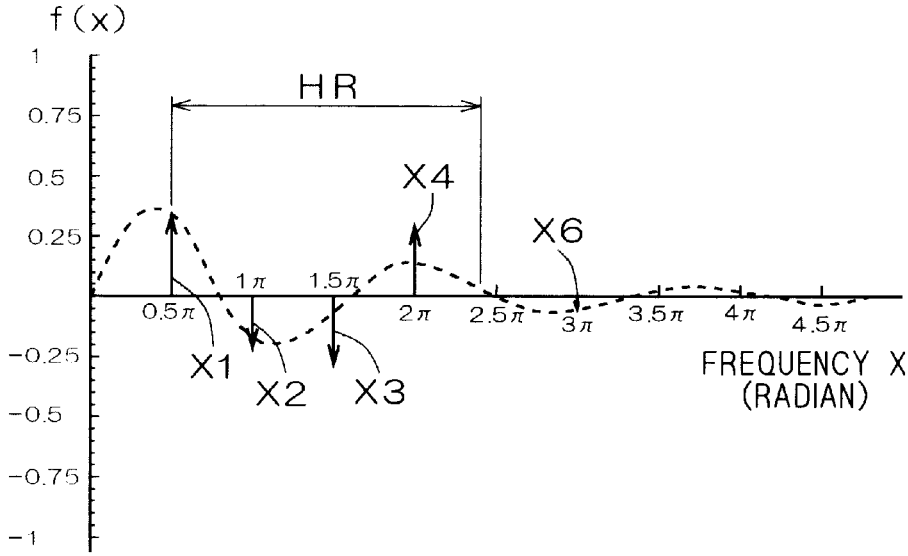
FIG. 12 is a diagram showing the pseudo-rectangular wave whose spectral quantity is increased reproduced in the sound emitting part.

FIG. 12 shows a spectrum in the case of inputting the pseudo-rectangular wave increasing the spectral quantities shown in FIG. 11 in the waveform tables TB and emitting a sound from the sound emitting part 90 through the reproducing system.

From FIG. 12, it is understood that the spectral quantities become high as compared with the case shown in FIG. 9 in X2, X3 and X4 among the spectral lines in the frequency domain HR. Therefore, not only energy density becomes high and sound emitting efficiency improves but also a sound emitting quantity rises and a more excellent reproduced sound can be obtained.

C. Example of Use of Pseudo-Rectangular Wave:

While it is also possible to form a chord by inputting the pseudo-rectangular wave described above, the same one in the respective ones of the plurality of waveform tables TB of the sound source device 100, reading the same in the respective waveform reading blocks RB while changing reading speeds respectively and adding the same, i.e., superposing waveforms having different frequencies with each other, deviation from the frequency domain HR of the sound emitting part 90 may be rendered preventable also when inputting different pseudo-rectangular waves in the respective ones of the waveform tables TB and information whose sound area is over a wide range is supplied from the music performance information source SS.

Figure 13:
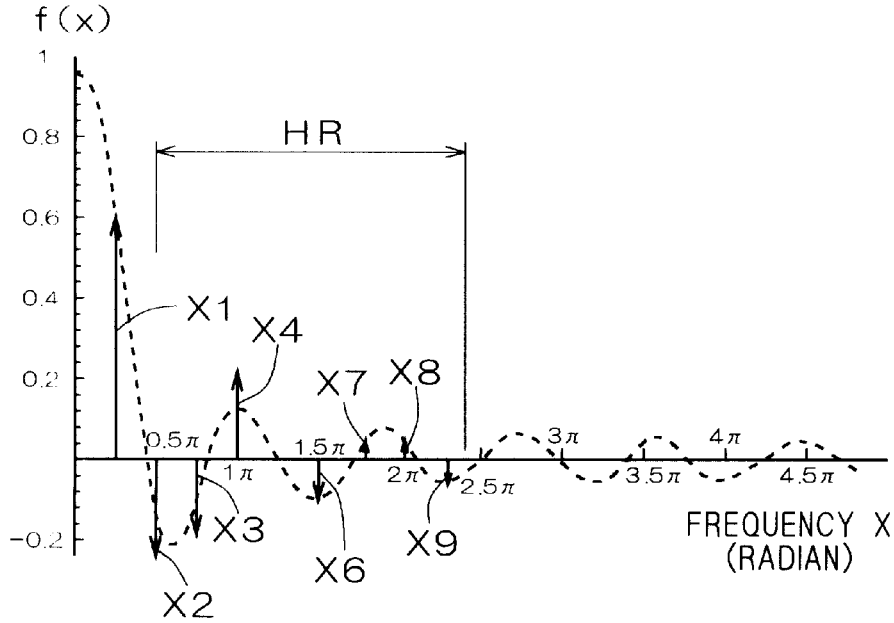
FIG. 13 is a diagram showing a spectrum in the case of lowering the frequency of a pseudo-rectangular wave.

FIG. 13 shows a spectrum in the case of lowering the frequency of the pseudo-rectangular wave shown in FIG. 11. Referring to FIG. 13, the frequency of a reference spectral line X1 is 0.25 π, whereafter spectral lines X2, X3, X4, X6, X7, X8 and X9 of harmonics are in forms appearing at intervals of the frequency 0.25 π. In the spectral characteristics described with reference to FIG. 10, the frequency of the reference spectral line X1 is 0.5 π, whereafter the spectral lines X2, X3, X4 and X6 of the harmonics have been in the forms appearing at intervals of the frequency 0.5 π. When the frequency domain HR of the sound emitting part 90 is within the range of 0.5 π radians to 2.5 π radians, therefore, those within this domain in FIG. 10 are the spectral lines X2, X3 and X4 and hence it was possible to increase the sound emitting quantity by multiplying the spectral quantities thereof by prescribed coefficients (multiplying the spectral liens X2, X3, X4 by 1.2, 1.3 and 2 respectively).

However, if trying to cope with the case where necessity for reproducing a sound of a low band (low frequency domain) is caused due to information from the sound performance information source SS, for example, by slowing down the reading speed for the pseudo-rectangular wave shown in FIG. 11 in the waveform reading blocks RB, the spectrum gets congested as shown in FIG. 13 to exhibit spectral characteristics as if the spectral lines X2, X3 and X4 move to one side of the frequency domain HR and start to deviate from the frequency domain HR.

Referring to FIG. 13, spectral lines X6, X7, X8 and X9 exist in the frequency domain HR of the sound emitting part 90 in addition to the spectral lines X2, X3 and X4, and hence the sound emitting quantity remains small as to the spectral lines X6, X7, X8 and X9 and becomes hard to hear in this state.

Therefore, a pseudo-rectangular wave having a low frequency is prepared independently of the pseudo-rectangular wave shown in FIG. 11 and input in another waveform table TB thereby using the same when reproducing a low band sound.

Figure 14:
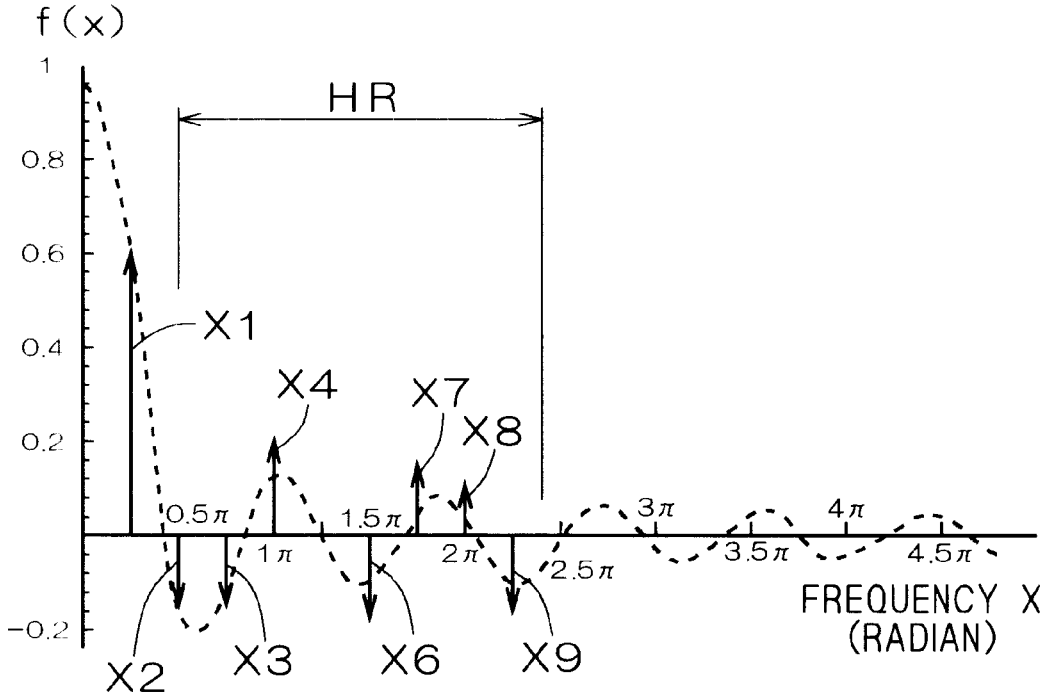
FIG. 14 is a diagram showing a spectrum for synthesizing a pseudo-rectangular wave of a low frequency taking the frequency characteristics of the sound emitting part into consideration.

FIG. 14 shows spectral characteristics for synthesizing a pseudo-rectangular wave of a frequency half the pseudo-rectangular wave shown in FIG. 11.

Referring to FIG. 14, the frequency of a reference spectral line X1 is 0.25 π, whereafter spectral lines X2, X3, X4, X6, X7, X8 and X9 of harmonics are in forms appearing at intervals of the frequency 0.25 π. The spectral quantities of the spectral liens X3, X4, X6, X7, X8 and X9 other than the spectral line X1 which is the reference line and the spectral line X2 which is a second-order harmonic component increase. The degree of the increase is such that the spectral lines X3, X4, X6, X7, X8 and X9 are 1.2 times, 1.5 times, twice, 2.5 times, twice and 1.5 times respectively as compared with values on the envelope.

Respective coefficients are so set that a natural reproduced sound is obtained and a high tone and a tone do not become excessively large. For example, coefficients of spectral lines of the high tone are set large and coefficients of spectral lines of the low tone are set small when the frequency characteristics of the sound emitting part 90 are those enhancing the low sound domain.

Figure 15:
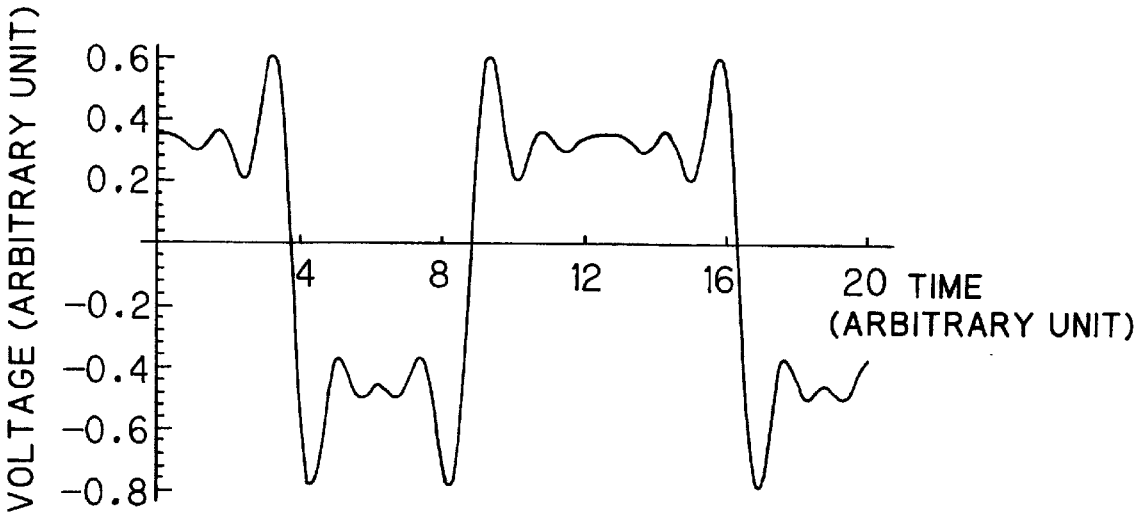
FIG. 15 is a diagram showing the pseudo-rectangular wave of the low frequency taking the frequency characteristics of the sound emitting part into consideration.

FIG. 15 shows the pseudo-rectangular wave synthesized on the basis of such a spectrum. In FIG. 15 time (arbitrary unit) is shown on the horizontal axis and voltage (arbitrary unit) is shown on the vertical axis. Referring to FIG. 14, it includes only harmonic components up to the ninth order, and hence the pseudo-rectangular wave of FIG. 15 becomes such a one that harmonic components exceeding the tenth order are eliminated.

In the pseudo-rectangular wave shown in FIG. 15, the frequency is halved and the corrugated shape of the top portion also becomes complicated as compared with the pseudo-rectangular wave shown in FIG. 11, for example.

While the example preparing the pseudo-rectangular wave whose frequency is half as compared with the pseudo-rectangular wave shown in FIG. 11 has been shown in the above description, it is needless to say that, the one whose frequency is higher than the pseudo-rectangular wave shown in FIG. 11 or the one whose frequency is further lower than the pseudo-rectangular wave shown in FIG. 15 may be prepared and input in the plurality of waveform tables TB respectively.

Thus, excellent reproduced sounds can be obtained with respect to various music performance information by inputting a plurality of pseudo-rectangular waves whose frequencies are different from each other in the respective waveform tables TB and selecting a pseudo-rectangular wave most excellently matching with the frequency domain HR of the sound emitting part 90 in correspondence to the information from the music performance information source SS.

As to selection of the waveform tables TB, they may be selectively used for a high band and a low band in single music performance, for example, it may be so devised as to use only the waveform tables TB for the high band in music performance having a tendency of high band and use only the waveform tables TB for the low band in music performance having a tendency of low band.

It also becomes possible to reproduce various instrumental sounds having different timbre by inputting pseudo-rectangular waves having different tone colors in the respective ones of the plurality of waveform tables TB.

D. Modification

While the sound source device 100 shown in FIG. 1 has comprised the waveform forming parts 80 plural, the waveform forming part 80 may be only one. In this case, it is possible to obtain such a reproduced sound that the sound emitting efficiency improves and the sound emitting quantity is also large by inputting a pseudo-rectangular wave increasing the spectral density and increasing the spectral density and increasing the sound emitting quantity in compliance with the frequency domain HR of the sound emitting part 90 in the waveform tables TB, as shown in FIG. 11.

Also when the waveform table TB is one, it is also possible to form a chord by reading waveforms of different frequencies plural by changing reading speeds and superposing these.

While the structure arranging the waveform tables TB as storage means on the waveform forming parts 80 and inputting the pseudo-rectangular wave previously prepared in compliance with the frequency domain HR of the sound emitting part 90 therein has been shown in the sound source device 100 shown in FIG. 1, it may not comprise the waveform tables TB as storage means but may comprise a sine wave synthesizing circuit, for example, forming a pseudo-rectangular wave in compliance with the frequency characteristics of the sound emitting part 90.

While the invention has been described in detail as the above, the foregoing description is in all aspects illustrative and the present invention is not restricted to this. It is understood that numerous unillustrated modifications can be assumed without departing from the scope of the present invention.

What is claimed is:

1. A sound source device comprising a waveform table having previously generated waveform data and a waveform reading part reading said waveform data from said waveform table at an arbitrary reading interval for reading said waveform data at a prescribed interval on the basis of externally supplied music performance information and outputting the same from a sound emitting part as a reproduced sound, wherein said waveform data is a pseudo-rectangular wave obtained by eliminating a harmonic component exceeding a prescribed order from a rectangular wave.

2. The sound source device according to claim 1, wherein said eliminated harmonic components is a harmonic component having a frequency exceeding a prescribed frequency domain in at least the frequency characteristics of said sound emitting part.

3. The sound source device according to claim 2, wherein said pseudo-rectangular wave has such spectral density that spectral density in a prescribed frequency domain in the frequency characteristics of said sound emitting part in the case of Fourier-transforming said pseudo-rectangular wave is higher than a rectangular wave having a pulse duty factor of 50%.

4. The sound source device according to claim 1, wherein said pseudo-rectangular wave has such spectral density that spectral density in a prescribed frequency domain in the frequency characteristics of said sound emitting part in the case of Fourier-transforming said pseudo-rectangular wave is higher than a rectangular wave having a pulse duty factor of 50%.

5. The sound source device according to claim 4, wherein said pseudo-rectangular wave is such that the spectral quantity of spectral lines excluding at least a reference spectral line among spectral lines in said prescribed frequency domain in the case of Fourier-transforming said pseudo-rectangular wave is at a value obtained by multiplying the spectral quantity at a corresponding frequency by a prescribed coefficient in a continuous spectrum in the case of Fourier-transforming an isolated rectangular wave.

6. The sound source device according to claim 1, wherein said waveform tables are plural and have waveform data of different forms respectively.

7. The sound source device according to claim 6, further comprising control means controlling an operation of reading the waveform data of said plural waveform tables at various frequencies respectively and superposing the same and an operation of differently using the same individually in compliance with said music performance information.

8. The sound source device according to claim 1, wherein said waveform tables are plural and have waveform data of the same form respectively.

9. A portable apparatus having said sound emitting part and said sound source device according to claim 1, wherein said sound emitting part is miniaturized so as to be housed in said portable apparatus.

10. A sound source device comprising a waveform table having previously generated waveform data and a waveform reading part reading said waveform data from said waveform table at an arbitrary reading interval for reading said waveform data at a prescribed interval on the basis of externally supplied music performance information and outputting the same from a sound emitting part as a reproduced sound, wherein said waveform data is such a pseudo-rectangular wave that the top portion of the wave has a corrugated shape where irregularities continue and leading and trailing edges of the waveform have inclinations.

11. The sound source device according to claim 10, wherein said pseudo-rectangular wave is such that the pulse widths of two pulse waves included in one cycle are different from each other.

12. The sound source device according to claim 10, wherein said pseudo-rectangular wave is such that heights of said irregularities include different heights.

13. The sound source device according to claim 10, wherein said waveform tables are plural and have waveform data of the same form respectively.

14. The sound source device according to claim 13, further comprising control means controlling an operation of reading the waveform data of said plural waveform tables at various frequencies respectively and superposing the same and an operation of differently using the same individually in compliance with said music performance information.

15. The sound source device according to claim 13, further comprising control means controlling an operation of reading the waveform data of said plural waveform tables at various frequencies respectively and superposing the same and an operation of differently using the same individually in compliance with said music performance information.

16. The sound source device according to claim 10, wherein said waveform tables are plural and have waveform data of different forms respectively.

17. A portable apparatus having said sound emitting part and said sound source device according to claim 10, wherein said sound emitting part is miniaturized so as to be housed in said portable apparatus.

* * * * *

UNITED STATES PATENT AND TRADEMARK OFFICE

CERTIFICATE OF CORRECTION

PATENT NO. : 6,506,968 B1 
DATED : January 14, 2003
INVENTOR(S) : Shigeki Kurihara It is certified that error appears in the above-identified patent and that said Letters Patent is hereby corrected as shown below:

Title page,
Item [73], Assignee, change "Rohn Co., Ltd." to -- Rohm Co., Ltd. --

Signed and Sealed this

Twenty-ninth Day of July, 2003

JAMES E. ROGAN
*Director of the United States Patent and Trademark Office*